US008936252B2

(12) United States Patent
Merino et al.

(10) Patent No.: US 8,936,252 B2
(45) Date of Patent: Jan. 20, 2015

(54) SAFETY BINDING FOR SKIING

(75) Inventors: Jean-François Merino, Epagny (FR); Laurent Marechal, Villaz (FR)

(73) Assignee: Salomon S.A.S., Metz-Tessy (FR)

( * ) Notice: Subject to any disclaimer, the term of this patent is extended or adjusted under 35 U.S.C. 154(b) by 553 days.

(21) Appl. No.: 13/281,974

(22) Filed: Oct. 26, 2011

(65) Prior Publication Data

US 2012/0104707 A1 May 3, 2012

(30) Foreign Application Priority Data

Oct. 29, 2010 (FR) ..... 10 04275

(51) Int. Cl.

| | |
|---|---|
| ***A63C 9/00*** | (2012.01) |
| ***A63C 9/08*** | (2012.01) |
| ***A63C 9/081*** | (2012.01) |
| ***A63C 9/085*** | (2012.01) |
| *A63C 9/084* | (2012.01) |

(52) U.S. Cl.

CPC ..... *A63C 9/0807* (2013.01); *A63C 9/005* (2013.01); *A63C 9/0805* (2013.01); *A63C 9/081* (2013.01); *A63C 9/08521* (2013.01); *A63C 9/08585* (2013.01); *A63C 9/006* (2013.01); *A63C 9/084* (2013.01)

USPC ..... 280/11.32; 280/634; 280/623

(58) Field of Classification Search

CPC .... A63C 9/005; A63C 9/08564; A63C 9/001; A63C 9/0805; A63C 9/08521; A63C 9/08585

USPC ..... 280/11.33, 11.34, 11.32, 614, 615, 617, 280/616, 618, 620, 623, 625, 626, 627, 633, 280/634

See application file for complete search history.

(56) References Cited

U.S. PATENT DOCUMENTS

| | | | | | |
|---|---|---|---|---|---|
| 2,994,543 | A | * | 8/1961 | Hvam | 280/630 |
| 3,455,570 | A | * | 7/1969 | Salomon | 280/629 |
| 3,687,470 | A | * | 8/1972 | Wilkes | 280/627 |
| 3,785,667 | A | * | 1/1974 | Nagasaki | 280/629 |
| 3,806,143 | A | * | 4/1974 | Wyss | 280/625 |
| 3,810,645 | A | * | 5/1974 | Vouthier | 280/633 |
| 3,813,110 | A | * | 5/1974 | Sittmann | 280/623 |
| 3,820,804 | A | * | 6/1974 | Benner | 280/632 |
| 3,866,929 | A | * | 2/1975 | Lacroix | 280/626 |
| 3,881,738 | A | * | 5/1975 | Salomon | 280/634 |
| 3,900,207 | A | * | 8/1975 | Iizuka | 280/625 |
| 3,902,728 | A | * | 9/1975 | Salomon | 280/629 |
| 3,951,423 | A | * | 4/1976 | Kaineder et al. | 280/625 |

(Continued)

FOREIGN PATENT DOCUMENTS

| | | |
|---|---|---|
| DE | 42 38 657 A1 | 5/1994 |
| DE | 20 2010 001 913 U1 | 6/2010 |

(Continued)

*Primary Examiner* — Brodie Follman

(74) *Attorney, Agent, or Firm* — Greenblum & Bernstein, P.L.C.

(57) ABSTRACT

The invention relates to a safety binding for skiing, including a toe piece that includes a body mounted to slide vertically relative to a front mounting base connected to the ski and defining an upper stop for a boot; a device for adjusting the vertical position of the body, which can be manipulated by the skier in the area of the upper portion of the body; at least one lever pivotally mounted relative to the body about a substantially vertical axis between a retaining position and a release position of a boot; and a spring mounted transversely in the body and biasing the lever toward its boot-retaining position.

25 Claims, 6 Drawing Sheets

(56) References Cited

U.S. PATENT DOCUMENTS

| | | | | | |
|---|---|---|---|---|---|
| 3,970,326 | A | * | 7/1976 | Salomon | 280/626 |
| 4,000,908 | A | * | 1/1977 | Weigl | 280/623 |
| 4,029,336 | A | * | 6/1977 | Haimerl | 280/614 |
| 4,111,453 | A | * | 9/1978 | Krob | 280/626 |
| 4,123,084 | A | * | 10/1978 | Takahashi | 280/630 |
| 4,125,275 | A | * | 11/1978 | Krob et al. | 280/626 |
| 4,286,801 | A | * | 9/1981 | Richert | 280/629 |
| 4,345,776 | A | * | 8/1982 | Salomon | 280/629 |
| 4,384,733 | A | * | 5/1983 | Krob et al. | 280/632 |
| 4,434,997 | A | * | 3/1984 | Nitschko | 280/625 |
| 4,480,850 | A | * | 11/1984 | Schneider | 280/630 |
| 4,516,792 | A | * | 5/1985 | Scheck et al. | 280/625 |
| 4,538,828 | A | * | 9/1985 | Dimier | 280/628 |
| 4,598,928 | A | * | 7/1986 | Konwitza | 280/618 |
| 4,756,545 | A | * | 7/1988 | Freisinger et al. | 280/618 |
| 4,938,497 | A | * | 7/1990 | Goud | 280/625 |
| RE33,388 | E | * | 10/1990 | Sedlmair et al. | 280/625 |
| 4,960,289 | A | * | 10/1990 | Stritzl et al. | 280/630 |
| 4,974,869 | A | * | 12/1990 | Muhlberger et al. | 280/625 |
| 4,979,762 | A | * | 12/1990 | Gallet | 280/625 |
| 5,028,069 | A | * | 7/1991 | Janisch et al. | 280/625 |
| 5,040,821 | A | * | 8/1991 | Berthet et al. | 280/625 |
| 5,044,657 | A | * | 9/1991 | Freisinger et al. | 280/625 |
| 5,050,903 | A | * | 9/1991 | Stritzl et al. | 280/625 |
| 5,056,810 | A | * | 10/1991 | Rigal | 280/625 |
| 5,125,680 | A | * | 6/1992 | Bejean et al. | 280/615 |
| 5,188,388 | A | * | 2/1993 | Rohrmoser | 280/633 |
| 5,205,575 | A | * | 4/1993 | Wladar | 280/625 |
| 5,211,419 | A | * | 5/1993 | Gorliez et al. | 280/633 |
| 5,215,326 | A | * | 6/1993 | Baron et al. | 280/636 |
| 5,236,218 | A | * | 8/1993 | Rohrmoser | 280/630 |
| 5,344,180 | A | * | 9/1994 | Lancon et al. | 280/625 |
| 5,388,851 | A | * | 2/1995 | Challande et al. | 280/625 |
| 5,501,483 | A | * | 3/1996 | Stepanek et al. | 280/625 |
| 5,529,331 | A | * | 6/1996 | Hoelzl et al. | 280/634 |
| 5,722,681 | A | * | 3/1998 | Merino et al. | 280/634 |
| 5,735,541 | A | * | 4/1998 | Fritschi et al. | 280/617 |
| 6,126,190 | A | * | 10/2000 | Viodet | 280/633 |
| 6,588,791 | B1 | * | 7/2003 | Horn | 280/613 |
| 6,779,809 | B2 | * | 8/2004 | Thomas et al. | 280/623 |
| 7,758,062 | B2 | * | 7/2010 | Klubitschko | 280/613 |
| 8,181,985 | B2 | * | 5/2012 | Mangold et al. | 280/614 |
| 8,201,836 | B2 | * | 6/2012 | Holzer et al. | 280/14.22 |
| 8,328,225 | B2 | * | 12/2012 | Prigge et al. | 280/614 |
| 8,439,389 | B2 | * | 5/2013 | Moore et al. | 280/617 |
| 8,579,317 | B2 | * | 11/2013 | Merino et al. | 280/611 |
| 2003/0137129 | A1 | * | 7/2003 | DuBuque | 280/615 |
| 2008/0290630 | A1 | * | 11/2008 | Pupko | 280/617 |
| 2008/0309053 | A1 | * | 12/2008 | Mangold et al. | 280/614 |
| 2009/0071019 | A1 | * | 3/2009 | Pupko | 33/6 |
| 2012/0018981 | A1 | * | 1/2012 | Lengel | 280/623 |
| 2012/0104707 | A1 | * | 5/2012 | Merino et al. | 280/11.33 |
| 2013/0026736 | A1 | * | 1/2013 | Marechal et al. | 280/617 |
| 2013/0069342 | A1 | * | 3/2013 | Merino et al. | 280/611 |

FOREIGN PATENT DOCUMENTS

| | | | |
|---|---|---|---|
| EP | 2 174 695 | A1 | 4/2010 |
| FR | 2 952 308 | A1 | 5/2011 |
| WO | WO-96/23559 | A1 | 8/1996 |
| WO | WO-00/29078 | A1 | 5/2000 |

* cited by examiner 700
501
504
726
7
A
761
A
728
321
301
751
502
711
503
420
300

728
501
700
504
7
726
761
711
301
321
751
502
503
420
300

A - A

SAFETY BINDING FOR SKIING

CROSS-REFERENCE TO RELATED APPLICATION

This application is based upon French Patent Application No. 10/04275, filed Oct. 29, 2010, the disclosure of which is hereby incorporated by reference thereto in its entirety, and the priority of which is claimed under 35 U.S.C. §119.

BACKGROUND

1. Field of the Invention

The invention relates to a safety binding for skiing, more particularly a safety binding that is adjustable to receive an article of footwear, such as a ski boot, having support projections of various dimensions, such as thicknesses.

2. Background Information

A safety binding for skiing should allow the release of the skier's boot to prevent injury to the foot in the case of an accidental transverse movement of the boot, which may occur during a fall, for example, or, in general, to protect the foot from injury when the forces exerted on the boot exceed predetermined values.

Safety bindings for the practice of ski touring must meet these release requirements. A ski touring binding must also enable the boot to rotate about a transverse axis relative to the ski, located at the front of the boot during the ascent phases, so that the heel of the skier can move away from the ski in order to exert optimum thrust. Such a binding must also make it possible to dampen substantial torsional forces between the boot and the ski during the descent phases.

The ski touring binding sold by Fritschi Corporation under the name Diamir Freeride includes a plate that is pivotally mounted relative to a front baseplate. The front baseplate is adapted to be fixed rigidly to the ski. The binding also includes a rear baseplate adapted to be fixed rigidly to the ski. The plate is selectively released from, or fixed to, the rear baseplate. A toe piece is pivotally mounted about a vertical axis on the front end of the plate. The toe piece has a body that is laterally elongated to form two wings for supporting the foot transversely. A heel piece is fixed to the rear end of the plate.

The body of the toe piece is relatively compact and is in a relatively raised position; it allows for a fairly substantial pivoting of the plate in the ascent position.

A spring is housed within the front end of the plate. The spring returns the toe piece body toward a position for retaining the foot of the skier. The spring defines the transverse force of the skier's foot beyond which the boot of the skier is released by the toe piece. The boot then pushes back one of the wings and pivots the toe piece body forward until it is released.

The vertical support of the boot by the toe piece is obtained by blocking a front projection between two supports. To this end, the front projection is held between an edge of the body forming an upper stop and a support surface arranged in the plate and forming a lower stop. Ski touring boots and downhill ski boots have front projections of different thicknesses. To enable this binding to be used with both ski touring boots and downhill ski boots, the toe piece body is mounted to slide vertically relative to the plate. The rotation of an adjusting screw makes it possible to lower or raise the toe piece body with respect to the plate.

This binding does not guarantee optimum guiding of the ski in the descent position. Indeed, the support of the plate forming the lower stop is at a distance of 40 millimeters (mm) from the surface of the ski in order to facilitate forward pivoting of the plate. The ski boot is then held in a relatively raised position, which is unfavorable for controlling the ski, i.e., unfavorable to the guiding and steering of the ski. No known solution has made it possible to lower the support of the plate without affecting the space requirement of the toe piece and the ability of the toe piece to tilt in the ascent position.

Furthermore, ski touring bindings and downhill ski bindings have functional and operational constraints leading to quite different designs. It is thus difficult to design components common to these different bindings, which limits the possibility of economies of scale during manufacture.

SUMMARY

The invention overcomes one or more of the aforementioned disadvantages. The invention thus relates to a safety binding for skiing, including a toe piece, which comprises:

a body mounted to slide vertically relative to a front mounting base connected to the ski and defining an upper stop for a boot;

a device for adjusting the vertical position of the body, the device being manipulatable by the skier in the area of the upper portion of the body;

at least one lever pivotally mounted with respect to the body about a substantially vertical axis between a retaining position and a release position of a boot;

a spring mounted transversely in the body and biasing the lever toward its boot-retaining position.

According to an alternative embodiment, the binding includes a lower support cooperating with the upper stop of the body to ensure vertical support of a boot, the body being mounted to slide relative to the lower support, so that the adjustment of the vertical position of the body changes the spacing between the upper stop and the lower support.

According to another alternative embodiment; the adjustment travel of the vertical position of the body makes it possible to select a spacing that is as small as substantially 19 mm or as great as substantially 30 mm between the upper stop and the lower support.

According to another alternative embodiment, the binding is adapted to the practice ski touring and, for this purpose, further includes a plate whose front portion is pivotally mounted relative to a front baseplate, designed to be fixed to the ski, between an ascent position and a descent position, the body being mounted to slide vertically on the plate.

According to another alternative embodiment, the distance between the upper surface of the lower support and a ski to which the binding is fixed is less than 30 mm, and less than 28 mm in a particular embodiment, and advantageously less than 26 mm in yet another embodiment.

According to yet another alternative embodiment, the adjusting device includes a screw whose head is accessible in the upper portion of the body and a threaded element, such as a nut, fixed to the plate, the screw being rotatably mounted relative to the body and screwed into the threaded element.

According to an alternative embodiment, the binding further includes a rear baseplate structured to be fixed to the ski, as well as a mechanism for alternatively fixing and releasing the rear baseplate and the rear portion of the plate.

According to another alternative embodiment, the binding includes a heel piece mounted on the rear baseplate and adapted to be fixed to the rear baseplate in a descent position.

According to another alternative embodiment, the pivoting travel of the plate relative to the front baseplate is greater than or equal to 80°, greater than or equal to 85° in a particular embodiment, and advantageously greater than or equal to 90° in yet another embodiment.

According to yet another alternative embodiment, the body has a projecting portion in its lower portion and the front mounting base includes a housing having a shape complementary to that of the projecting portion in order to guide the body for sliding in a vertical direction.

According to an alternative embodiment, the binding is adapted for the practice of downhill skiing and, for this purpose, the front mounting base is structured and arranged to be fixed to the ski.

According to another alternative embodiment, the front mounting base guides the body for sliding in a vertical direction.

According to yet another alternative embodiment, the body has a projecting portion in its lower portion and the front mounting base includes a housing having a shape complementary to that of the projecting portion in order to guide the body for sliding in a vertical direction.

The invention also relates to a ski equipped with a binding as defined hereinabove.

BRIEF DESCRIPTION OF DRAWING

Other characteristics and advantages of the invention will be more apparent from the description that follows, with reference to the annexed drawings illustrating, by way of non-limiting embodiments, how the invention can be embodied, and in which.

DETAILED DESCRIPTION

Figure 1:
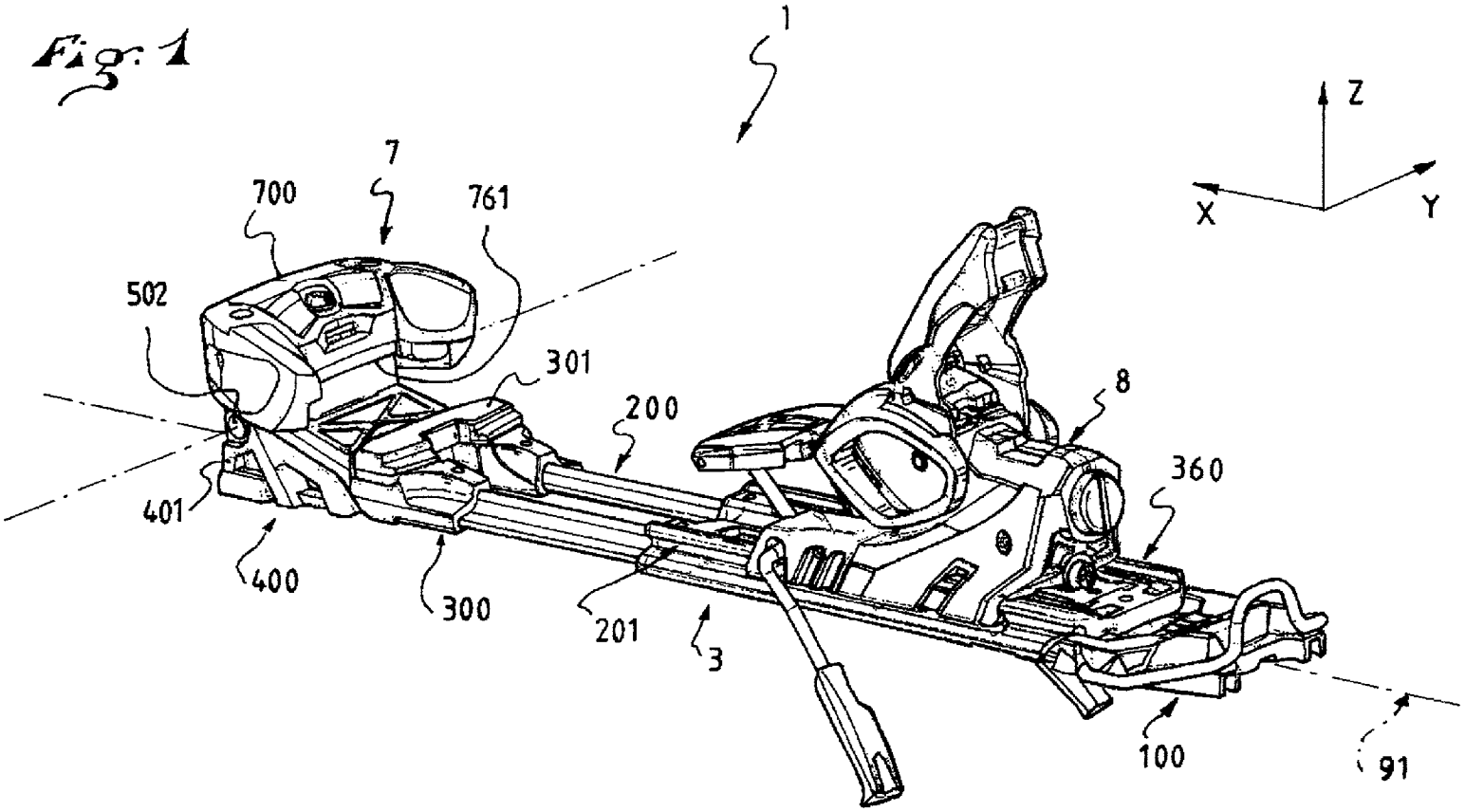
FIG. 1 is a perspective view of a safety binding according to a first embodiment of the invention, adapted for the practice of ski touring.

The frame of reference depicted in FIG. 1 is used in the following description. The X-direction corresponds to the axial direction of a plate of the binding. The Y-direction corresponds to the transverse direction of the ski, and the Z-direction corresponds to the normal direction of the plate of the binding, i.e., perpendicular to the upper surface of the ski. The Z-direction also designates the vertical direction within the context of the invention, i.e., with the binding considered to be mounted on a horizontal surface. The binding used is associated with the binding plate. Thus, the binding can move relative to the ski, for example, when the plate is pivotally mounted relative to the ski, as is the case when used in ski touring. However, the binding can also be stationary relative to ski when the plate is affixed to the ski, as is the case when used in downhill skiing.

The safety binding 1 shown in FIG. 1 is a dual purpose binding, that is to say a binding intended for selectively practicing downhill skiing or ski touring. The safety binding 1 includes a front baseplate 400 structured and arranged to be fixed rigidly to a ski. The binding 1 also includes a plate 3 pivotally mounted with respect to the front baseplate 400, about a transverse axis. The binding 1 further includes a rear baseplate 100 structured and arranged to be fixed rigidly to the ski.

The plate 3 includes a front mounting base 300 forming its front end and pivotally mounted relative to the baseplate 400, about a transverse axis. A toe piece 7 is mounted on the front mounting base 300. The plate 3 also includes a rear mounting base 360 forming its rear end. A heel piece 8 is fixed in a known manner to the rear mounting base 360 and is structured and arranged to immobilize the heel of the skier. The rear mounting base 360 has a rail 201 and a notch (not shown) making it possible to slide and immobilize the heel piece 8 relative to the plate 3. Such an adjustment is known to one of ordinary skill in the art and, therefore, is not be further described. The toe piece 7 and heel piece 8 are axially offset (the axial direction of the plate 3 is illustrated in FIG. 1 with a dashed line 91) to allow the insertion of a skier's boot. The front mounting base 300 and rear mounting base 360 are affixed to one another via a connecting member 200, or other structure connecting the front and rear mounting bases.

In the position shown in FIG. 1, the binding 1 is in the descent position. The rear mounting base 360 of the plate 3 is pressed flat against the rear baseplate 100. The rear mounting base 360 is then fixed to the rear baseplate 100 to allow the transmission of forces between the heel of the skier and the ski. The skier's foot and the plate 3 then cannot pivot relative to the ski. In the ascent position, the rear mounting base 360 is separated from the rear baseplate 100 in order to allow pivoting of the plate 3 and pivoting of the skier's foot relative to the ski.

Figure 2:
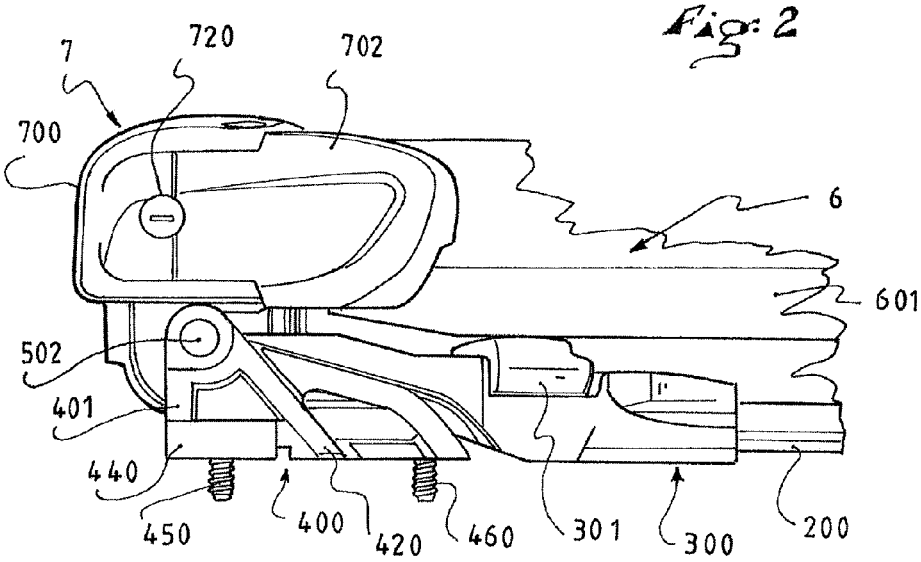
FIG. 2 is a side view of the binding of FIG. 1, in the area of its the toe piece.

As shown in FIG. 2, the baseplate 400 advantageously includes a first element 420 and a second element 440. The element 420 is slidably mounted in the element 440. The elements 420 and 440 are fixed to the ski via screws 460 and 450, respectively. A vertically extending stirrup 401 is arranged in the element 420 of the baseplate 400. The stirrup 401 includes two transversely offset surfaces between which the front mounting base 300 is housed. A shaft 502 connects the two surfaces of the stirrup 401 in the area of its upper portion. The shaft 502 extends through bores 311 and 312 (see FIG. 6) arranged in the front end of the front mounting base 300. The shaft 502 extending through the bores 311, 312 and connecting the surfaces of the stirrup 401 thus enables the plate 3 to be rotationally guided about a transverse axis relative to the baseplate 400.

The front mounting base 300 has a lower support 301 for the sole 601 of a ski boot 6 of the skier. The lower support 301 may be unitary with or attached to the front mounting base 300 in any appropriate manner, such as by means of screws. Within the scope of the invention is the lower support 301 being movably mounted on the front mounting base 300 in order to accompany the sole 601 when the boot 6 is being released. The toe piece 7 includes a body 700. The body 700 has an edge 761, or surface, adapted to be positioned straight above a projection 602 of the front portion of the sole 601 of the boot 6, when the boot is retained by the binding 1. During use of the safety binding 1, the front mounting base 300 and the body 700 are connected rigidly, so that the vertical movements of the boot 6 relative to the binding 1 are constrained, i.e., prevented. The body 700 also defines the axial position of a boot 6.

The vertical spacing between the edge 761 and the lower support 301. substantially corresponds to the distance between the upper portion of the projection 602 and the bottom of the sole 601, except for a clearance. This distance is standardized for both an alpine ski boot and a ski touring boot. This spacing is 19±1 mm for a downhill ski boot, and 28±3 mm for a ski touring boot. According to the invention, this spacing is adjustable so that the safety binding can be used either with a downhill ski boot or with a ski touring boot. The adjustable spacing also enables boots with projections to be used according to new standards that may take effect.

Figure 4:
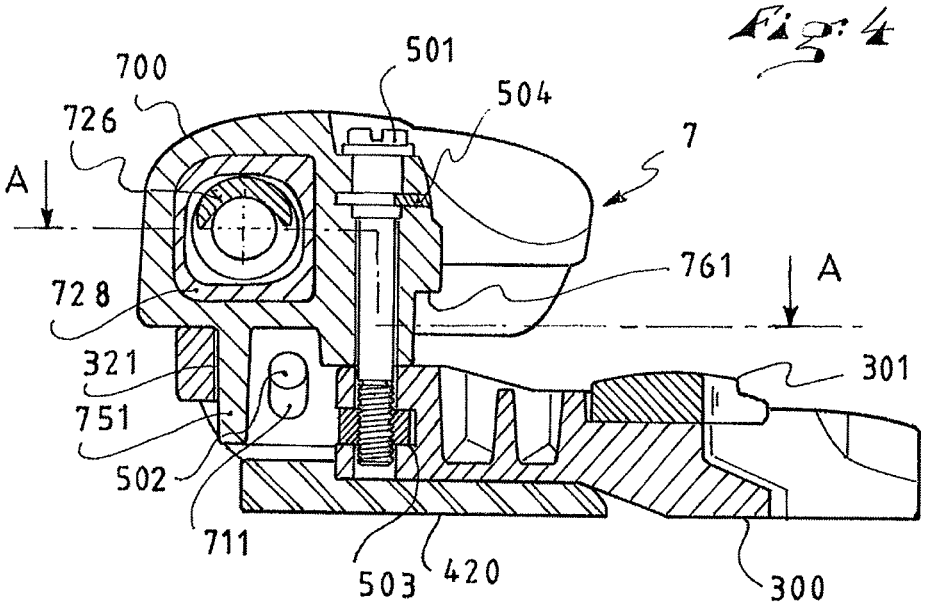
FIGS. 4 and 5 are cross-sectional side views in the area of the toe piece, in various positions of the binding of FIG. 1.
Figure 5:
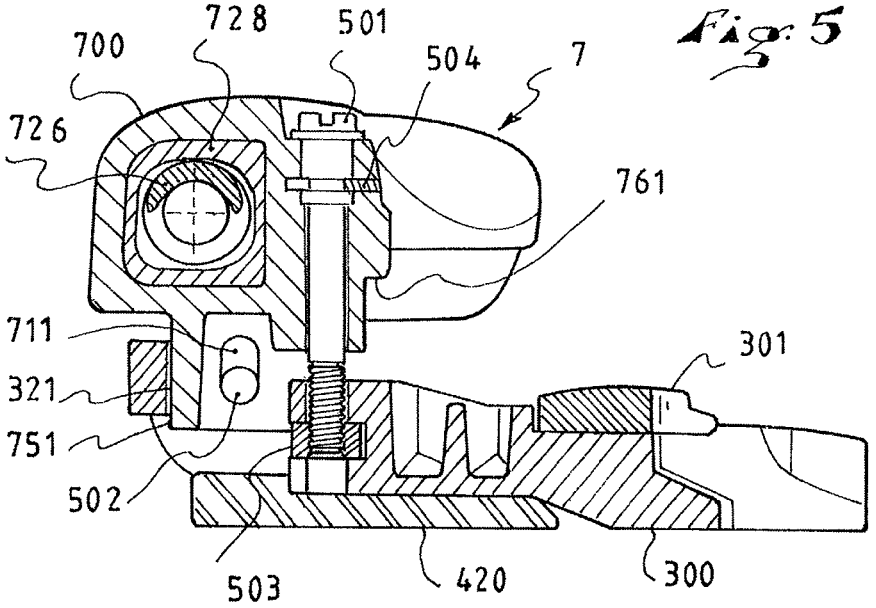

FIGS. 4 and 5 illustrate an adjustment of the binding 1 for an alpine ski boot and a ski touring boot, respectively. The binding 1 has a structural device or arrangement for adjusting the spacing between the edge 761 and the lower support 301.

In practice, the adjustment is generally carried out when the binding is adjusted into the downhill skiing configuration. Thus, the frame of reference of the plate is substantially the same as that of the ski.

A screw 501 is rotationally mounted relative to the body 700. To this end, the screw 501 extends through a vertical bore 765 arranged in the body 700. A circlip 504 is engaged in a groove of the screw 501. The circlip 504 cooperates with the body 700 to couple the screw 501 to the body 700 in a vertical orientation. The head of the screw 501 is in contact with a surface 766 in the upper portion of the body 700.

A nut 503 is housed permanently in a slot of the front mounting base 300. The screw 501 is threadedly coupled to the nut 503. The nut 503 is thus immobilized relative to the front mounting base 300. The vertical position of the body 700 relative to the front mounting base 300 is set by screwing or unscrewing the screw 501, i.e., by turning it in one direction or the other within the nut 503.

Figure 6:
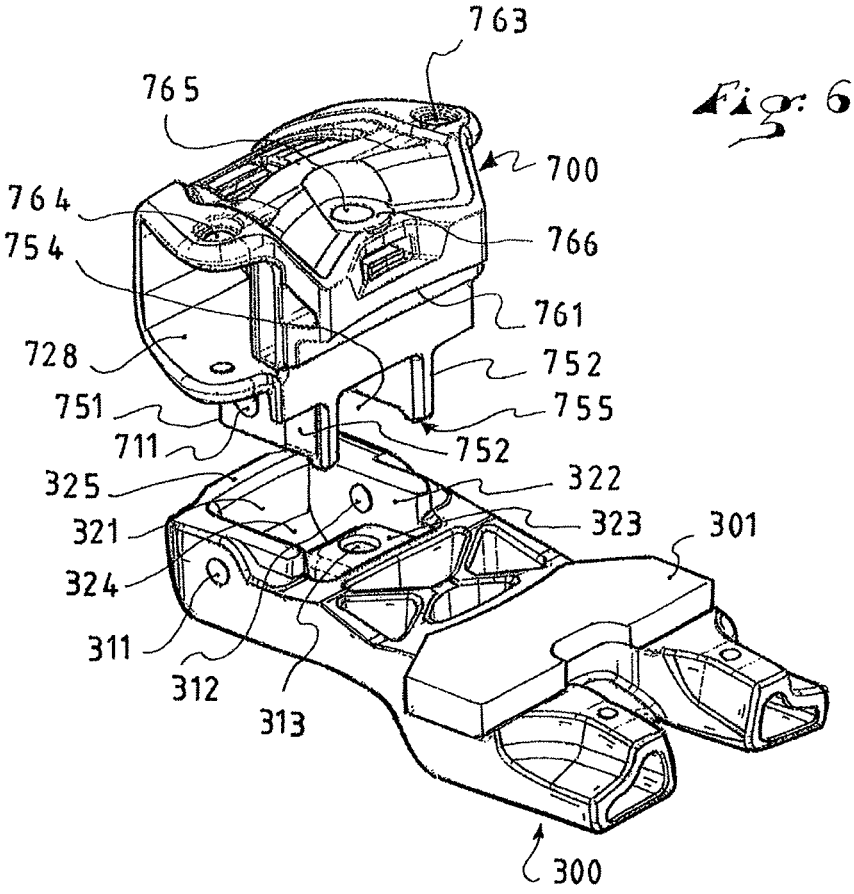
FIG. 6 is a perspective view of two components of the binding of FIG. 1.

The body 700 is guided in vertical sliding relative to the front mounting base 300 by various surfaces contacting one another. As shown in FIG. 6, the front mounting base 300 includes a wall 325 demarcating a volume 324 adapted to receive a lower portion of the body 700. The wall 325 has a flat, or planar, front surface 321 and flat, or planar, lateral surfaces 322 demarcating the volume 324. The front mounting base 300 also includes a block 323. The block 323 comprises a bore 313 structured and arranged to allow the screw 501 to extend therethrough. The lower portion of the body 700 comprises a wall 755 housed in the volume 324. The wall 755 comprises a front surface 751 coming into contact with the surface 321. The wall 755 includes lateral surfaces 752 coming into contact with the lateral surfaces 322. The wall 755 further demarcates a cavity 754 structured and arranged to receive the block 323.

Oblong bores 711 are arranged in the wall 755, in the area of the lateral surfaces 752. The oblong bores 711 extend vertically and are traversed by the shaft 502. The oblong bores 711 enable the body 700 to pivot relative to the axis 502, while being capable of sliding vertically relative to the front mounting base 300 and to the shaft 502.

In the example of FIG. 4, the spacing between the edge 761 and the lower support 301 accommodates the front of an alpine ski boot. The shaft 502 is arranged at the top of the oblong bore 711. In the example of FIG. 5, the spacing between the edge 761 and the lower support 301 accommodates the front of a ski touring boot. The shaft 502 is arranged in the bottom of the oblong bore 711.

The adjustment of the spacing between the edge 761 and the lower support 301 is advantageously carried out by moving the toe piece 7, the lower support 301 always remaining in the same vertical position relative to the ski in the descent position. Such an adjustment makes it possible to maintain the spacing between the ski and the skier's foot at a constant and reduced value, which makes it easier to operate the ski in the descent position.

As illustrated, the head of the screw 501 is advantageously accessible vertically in the area of the upper portion of the body 700. Such an access makes it possible to adjust the spacing easily, without interference from other components of the binding 1. The adjustment can be carried out with a screwdriver or other tool to be engaged with the head of the screw. Alternatively, a tool-less adjustment can be made if the head of the screw were to extend appropriately and have a suitable shape to be manipulatable, i.e., turned by hand. As can be seen in the cross-sectional side views of FIGS. 4 and 5, the screw 501 is designed for manual adjustment of the vertical position of the body 700, such vertical position defining a fixed position of the upper stop 761 of the body without the presence of the boot, i.e., without the boot being engaged with the upper stop. In addition, inasmuch as the spring 726 is housed within the body 700, the entirety of the spring is movable selectively by a user by the rotation of the screw, i.e., together with the adjustable movement of the body.

Figure 7:
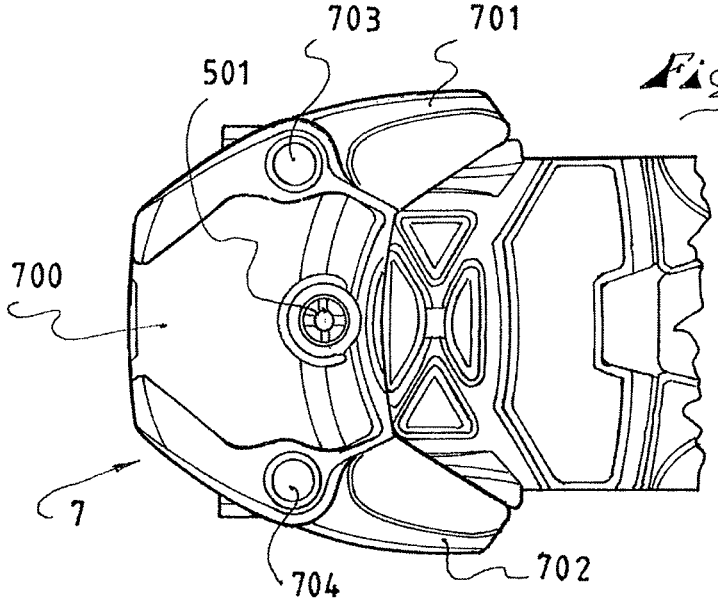
FIG. 7 is a top view of the binding of FIG. 1, in the area of the toe piece.
Figure 8:
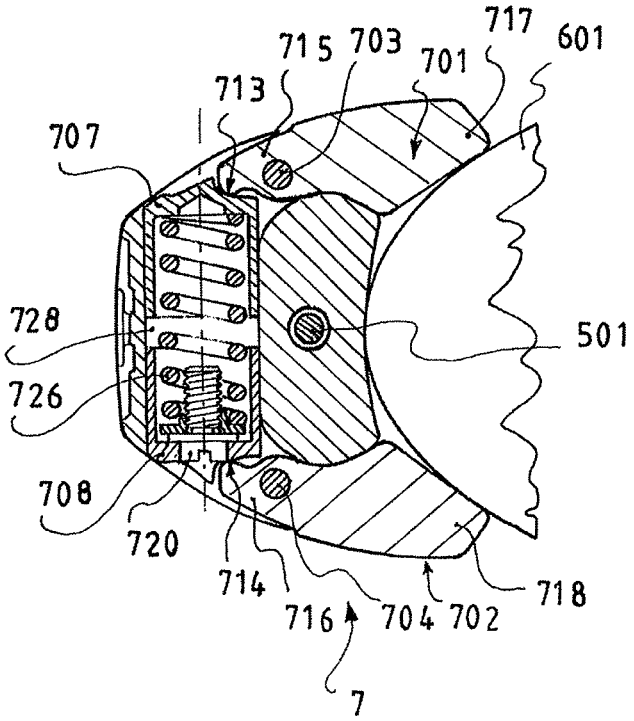
FIG. 8 is a cross-sectional top view of the binding of FIG. 1, in the area of the toe piece.

FIG. 7 is a top view of the front portion of the binding 1. FIG. 8 is a cross-sectional top view of the same front portion of the binding 1. The body 700 is provided with a housing 728. A helical compression spring 726 is arranged transversely in the housing 728, i.e., the helical turns of the spring extend around a transversely extending axis. The ends of the spring 726 are respectively in contact with pistons 707 and 708 arranged in the area of the respective transverse ends of the spring 726. The pistons 707 and 708 are slidably mounted in the housing 728. The pistons 707 and 708 serve as a base for the ends of the spring 726. Levers 701 and 702 are pivotally mounted about vertical axes 703, 704 relative to the body 700. The vertical axes 703 and 704 are comprised of shafts extending through bores 763 and 764, respectively, arranged in the body 700.

The levers 701 and 702 are arranged on respective ones of the two sides of the front projection 602 of the sole 601 in the boot-retaining position. The levers 701 and 702 respectively comprise cam portions 715 and 716 projecting relative to their pivot axes 703 and 704. The levers 701 and 702 respectively comprise portions 717 and 718 for the lateral support of the projection 602. The cam portions 715 and 716 and the lateral support portions 717 and 718 are arranged on opposite sides of the axes 703 and 704, respectively.

The pistons 707 and 708 have guiding surfaces. These guiding surfaces are kept against the cam portions 715 and 716, respectively, by the return force exerted by the spring 726.

Figure 3:
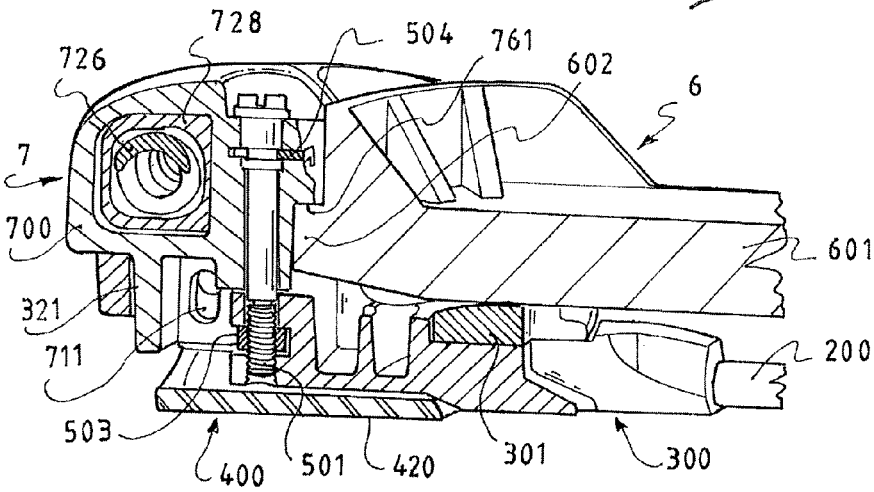
FIG. 3 is a cross-sectional perspective view of the binding of FIG. 1.

When the boot 6 exerts a transverse force exceeding a release threshold on a lateral support portion, the corresponding lever pivots about its axis. During this pivoting, the cam portion of the lever biases the contact surface of the corresponding piston. The piston is then slidably driven to bias one end of the spring 726. The spring 726 is then compressed sufficiently to enable an additional pivoting of the lever, thus enabling the projection 602 (see FIG. 3) to be released from the boot 6.

The binding 1 shown is provided with a device for adjusting a preload of the spring 726. Adjusting the preload of the spring 726 makes it possible to define the binding release force, or threshold, of the toe piece 7. The preload adjustment is carried out via a screw 720. Preload adjustment is known to one of ordinary skill in the art and is not further described herein.

The arrangement of the spring 726 inside the body 700 and in the transverse position has a number of advantages. Such an arrangement makes it possible to bring the lower support 301 closer to the ski as much as possible, as it avoids arranging the spring beneath the support. Thus, the steering of the ski in the descent position is optimized. The distance between the ski and the support 301 can thus be less than 30 mm, or less than 28 mm, or, advantageously, even less than 26 mm. Such an arrangement also makes it possible to obtain a toe piece 7 with a particularly reduced axial space requirement. The forward movement can thus be optimized, thereby improving the ease of use in the ascent position. In particular, the plate 3 can be provided to have rotation path of at least 80°, or greater than or equal to 85°, or even greater than or equal to 90°, which is particularly advantageous in the ascent position of the binding 1.

Figure 9:
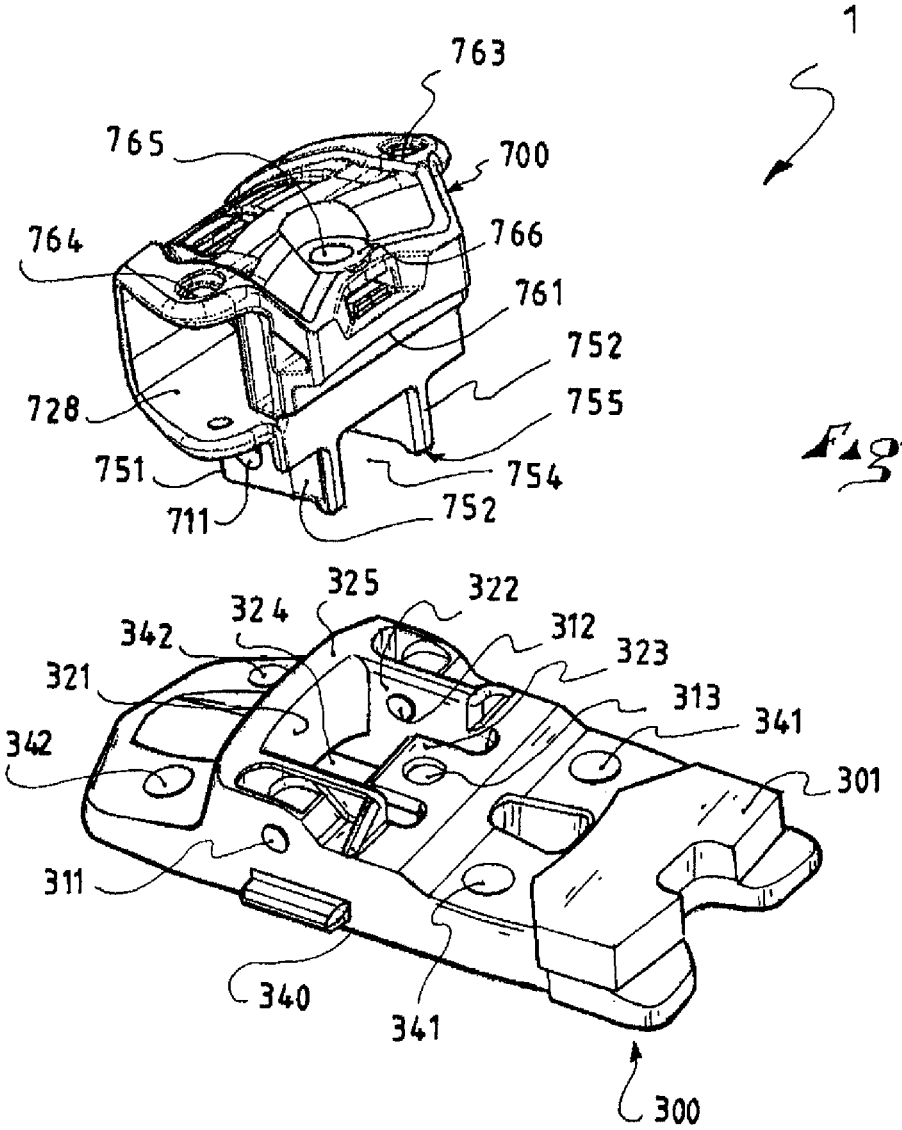
FIG. 9 is a perspective view of two components of a safety binding according to the second embodiment of the invention, adapted for the practice of downhill skiing.

FIG. 9 is a perspective view of two components of the front portion of a binding 1 for the practice of downhill skiing. Such a binding 1 does not have means for pivoting about a transverse axis and, therefore, does not allow the ascent. Only the body 700 of the toe piece 7 is shown. The toe piece 7 is otherwise identical to the toe piece of the embodiment of FIGS. 1-8 and is, therefore, not further described. The toe piece 7 includes an adjusting screw retained by a circlip. The binding 1 includes a front base or front mounting base 300 adapted to be fixed to the ski by flush connection. To this end, the front mounting base 300 comprises rear openings 341 and front openings 342 structured and arranged to receive therethrough respective fixing, or mounting, screws. The front mounting base 300 has a support 301 in its rear portion, structured and arranged to form a lower stop for the boot 6 of a skier. The front mounting base 300 comprises a flat lower support surface 340, structured and arranged to distribute the forces transmitted by the skier to the ski.

The body 700 is guided in vertical sliding relative to the front mounting base 300 by various surfaces contacting one another. The front mounting base 300 comprises a wall 325 demarcating a volume 324 adapted to receive the lower portion of the body 700. The wall 325 comprises a flat front surface 321 and flat lateral surfaces 322 demarcating the volume 324. The front mounting base 300 also includes a block 323. The block 323 has a bore 313 adapted to be received therethrough the screw 501. The wall 755 of the body 700 is housed in the volume 324. The front surface 751 comes in contact with the surface 321. The lateral surfaces 752 come into contact with the lateral surfaces 322. The cavity 754 of the body 700 receives the block 323. The wall 325 comprises bores 311 and 312 extending through its lateral surfaces 322. These bores 311 and 312 are traversed by a shaft, not shown, also extending through the oblong bores 711 of the body 700.

Thus, once the body 700 is assembled to the front mounting base 300, the only degree of freedom for the body 700 is vertical sliding. A nut, not shown, is housed permanently in a slot of the front mounting base 300, straight in line with the bore 313. The adjusting screw is coupled to the nut. The vertical position of the body 700 relative to the front mounting base 300 is defined by screwing or unscrewing the adjusting screw.

Such a binding 1 has advantages similar to those of the ski touring binding shown in FIGS. 1-8. This binding thus has a front mounting base 300 provided with a support 301 at a very short distance from the ski. The spacing between the foot and the ski is thus reduced, which promotes an optimal operation of the ski. Furthermore, the height adjustment between the support 301 and the edge 761 makes it possible to use other types of footwear, especially if the standard for the dimensions of the front projection 602 were to be changed. In particular, the invention encompasses the possibility of new, thicker projections being marketed for downhill ski boots. Such projections 602 would have an inclined lower surface, with a tapered end. Such projections 602 would facilitate walking, by promoting a rolling movement of the foot.

Thus, the safety binding 1 for downhill skiing can advantageously share a number of components with the ski touring binding shown in FIGS. 1-8. The toe piece 7, including the body 700, the spring 726, the height adjustment mechanism, and the wings 701 and 702, can be integrated either into a safety binding for downhill skiing or into a safety binding for ski touring.

The front mounting base 300 is always connected to the ski. In the first embodiment of FIGS. 1-8, the front mounting base 300 pivots relative to the ski due to a pivot connection between the front mounting base 300 and the plate 400 that is fixed directly to the ski. In the second embodiment of FIG. 9, the front mounting base 300 is fixed directly to the ski, due to a flush-type connection.

In the context of the invention, the vertical sliding of the body relative to the front mounting base 300 is a movement that makes it possible to change the spacing between the upper stop 761 and the lower support 301. This spacing, once adjusted, does not vary during use.

The lower support 301 is advantageously affixed to the front mounting base 300 which enables a direct adjustment of the spacing because the position of the upper stop 761, supported by the body 700, is adjustable relative to the front mounting base 300.

Advantageously, the screw 501 is also used to affix a friction element to the body 700 of the toe piece. Indeed, to ensure a smooth lateral release of the boot in the case of an impact, in order to meet the standard requirements, the front end of the boot needs to be capable of sliding transversely with respect to the body 700. To this end, the sliding must be facilitated in the area of the friction zone, between the boot and the body 700. To this end, one solution is to incorporate a friction element into this area of the body 700. Such a friction element is made of a suitable material, that is to say, a material having a low coefficient of friction with a common constituent material of a boot. PQM (polyoxymethylene), for example, is a suitable material. The body 700 must be stronger and is generally comprised of glass fiber-reinforced polyamide having a less favorable coefficient of friction.

For reasons of safety and standards, the friction element must not separate easily from the body. This involves additional structure for anchoring the friction element on the body. The proposed solution, in this case, is compact and optimized dimensionally as it does not require a specific anchoring arrangement for the friction element, the affixing of this element being provided by the screw 501, which is also used for the height adjustment of the body 700 of the toe piece.

Specifically, the friction element may include a plate perforated with a hole slightly larger than the diameter of the screw 501, the plate being adapted to be housed in a transverse slot of the body 700 relative to the vertical bore 765. Once assembled to the body, the hole of the perforated plate is aligned with the bore 765. Thus, when the screw 501 is mounted in the body, it prevents the retraction of the perforated plate and therefore affixes the friction element to the body 700.

The invention also relates to skis equipped with bindings as described hereinabove.

In addition to the foregoing, the invention disclosed herein by way of exemplary embodiments suitably may be practiced in the absence of any element or structure which is not specifically disclosed herein.

The invention claimed is:

1. A safety binding for binding a boot to a ski, said binding comprising:

a toe piece comprising:

a front mounting base structured and arranged to be connected to the ski;

a body defining an upper stop for the boot;

a body-mounting structure for mounting the body for vertical sliding relative to the front mounting base;

a vertical positioning device for adjusting a vertical position of the body, the device comprising a manipulatable structure positioned in an area of an upper portion of the body;

at least one lever pivotally mounted relative to the body about a substantially vertical axis, between a boot-retaining position and a boot release position;

a spring mounted transversely in the body and operably connected to the lever, biasing the lever toward the boot-retaining position of the lever.

2. A safety binding according to claim 1, further comprising:

a lower boot support structured and arranged to support the boot and to cooperate with the upper stop of the body to provide vertical support to the boot;

the body-mounting structure being structured and arranged to mount the body for sliding relative to the lower boot-support, thereby enabling an adjustment of a vertical position of the body and an adjustment of spacing between the upper stop and the lower boot support.

3. A safety binding according to claim 2, wherein:

the adjustment of the vertical position of the body by the vertical positioning device selectively defines a spacing that is as small as substantially 19 mm and as large as substantially 30 mm between the upper stop and the lower support.

4. A safety binding according to claim 1, further comprising:

a structure for facilitating use in downhill skiing, said downhill skiing structure comprising structure for fixing the front mounting base against movement relative to the ski.

5. A safety binding according to the claim 4, wherein:

the front mounting base is structured and arranged to guide the body along its vertical sliding.

6. A safety binding according to claim 1, wherein:

the manipulatable structure of the vertical positioning device is designed for manual adjustment by a user, with or without a tool, of the vertical position of the body, said vertical position defining a position of the upper stop of the body fixed without engagement of the boot with the upper stop.

7. A safety binding according to claim 6, wherein:

the manipulatable structure comprises a threaded member having an exposed end designed to be manipulated by a user from above the body of the toe-piece with or without a tool.

8. A safety binding according to claim 7, wherein:

the threaded member is a screw; and the exposed end is a head of the screw designed for engagement with a screwdriver.

9. A safety binding according to claim 1, wherein:

the spring is housed within the body of the toe piece and an entirety of the spring is movable selectively by a user by means of the manipulatable structure together with the body.

10. A safety binding according to claim 1, wherein:

the spring is a helical compression spring having an axis extending transversely.

11. A safety binding according to claim 10, further comprising:

a manually preload adjustment device designed to adjust a preload of the spring to define a binding release force to be applied by the boot against the at least one lever.

12. A safety binding according to claim 4, wherein:

the downhill skiing structure that comprises structure for fixing the front mounting base against movement relative to the ski comprises a plurality of through openings in the front mounting base structured and arranged to receive screws for mounting the front mounting base to fix the front mounting base to the ski.

13. A safety binding comprising:

a toe piece comprising:

a front mounting base structured and arranged to be connected to the ski;

a body defining an upper stop for the boot;

a body-mounting structure for mounting the body for vertical sliding relative to the front mounting base;

a vertical positioning device for adjusting a vertical position of the body, the device comprising a manipulatable structure positioned in an area of an upper portion of the body;

at least one lever pivotally mounted relative to the body about a substantially vertical axis, between a boot-retaining position and a boot release position;

a spring mounted transversely in the body and operably connected to the lever, biasing the lever toward the boot-retaining position of the lever;

structure for facilitating use in ski touring, said ski touring structure comprising:

a front baseplate structured and arranged to be fixed to the ski;

a plate having a front end formed by the front mounting base is pivotally mounted relative to a front baseplate, adapted to be fixed to the ski, between an ascent position and a descent position, the body being mounted to slide vertically on the plate.

14. A safety binding according to claim 13, further comprising:

a lower boot support structured and arranged to support the boot and to cooperate with the upper stop of the body to provide vertical support to the boot;

the body-mounting structure being structured and arranged to mount the body for sliding relative to the lower boot-support, thereby enabling an adjustment of a vertical position of the body and an adjustment of spacing between the upper stop and the lower boot support;

wherein the adjustment of the vertical position of the body by the vertical positioning device selectively defines a spacing that is less than 30 mm.

15. A safety binding according to claim 14, wherein:

the adjustment of the vertical position of the body by the vertical positioning device selectively defines a spacing that is less than 28 mm.

16. A safety binding according to claim 14, wherein:

the adjustment of the vertical position of the body by the vertical positioning device selectively defines a spacing that is less than 26 mm.

17. A safety binding according to claim 13, wherein:

the vertical positioning device includes a screw and a threaded screw-receiving element fixed to the plate;

the screw is pivotally mounted relative to the body and is threadedly engaged with the screw-receiving element.

the manipulatable structure of the vertical positioning device comprises a head of the screw accessible at the upper portion of the body.

18. A safety binding according to claim 13, further comprising:

a rear baseplate structured and arranged to be fixed to the ski; and a mechanism for alternatively fixing and releasing the rear baseplate and the rear portion of the plate.

19. A safety binding according to claim 18, further comprising:

a heel piece mounted on the rear baseplate and structured and arranged to be fixed to the rear baseplate in a descent position.

20. A safety binding according to claim 13, wherein:

pivoting movement of the plate relative to the front baseplate is greater than or equal to 80°.

21. A safety binding according to claim 13, wherein:

pivoting movement of the plate relative to the front baseplate is greater than or equal to 85°.

22. A safety binding according to claim 13, wherein:

pivoting movement of the plate relative to the front baseplate is greater than or equal to 90°.

23. A safety binding according to claim 13, wherein:

the body has a lower portion having projecting portion;

the front mounting base comprises a housing having a shape complementary to a shape of the projecting portion for guiding the body the vertical sliding relative to the front mounting base.

24. A safety binding comprising:

a toe piece comprising:

a front mounting base structured and arranged to be connected to the ski;

a body defining an upper stop for the boot;

a body-mounting structure for mounting the body for vertical sliding relative to the front mounting base;

a vertical positioning device for adjusting a vertical position of the body, the device comprising a manipulatable structure positioned in an area of an upper portion of the body;

at least one lever pivotally mounted relative to the body about a substantially vertical axis, between a boot-retaining position and a boot release position;

a spring mounted transversely in the body and operably connected to the lever, biasing the lever toward the boot-retaining position of the lever;

a structure for facilitating use in downhill skiing, said downhill skiing structure comprising structure for fixing the front mounting base against movement relative to the ski;

the front mounting base being structured and arranged to guide the body along its vertical sliding;

the body having a lower portion having a projecting portion;

the front mounting base comprising a housing having a shape complementary to a shape of the projecting portion for guiding the body in the vertical sliding relative to the front mounting base.

25. A ski assembly comprising:

a ski;

a safety binding adapted to be attached to the ski, the safety binding comprising:

a toe piece comprising:

a front mounting base structured and arranged to be connected to the ski;

a body defining an upper stop for the boot;

a body-mounting structure for mounting the body for vertical sliding relative to the front mounting base;

a vertical positioning device for adjusting a vertical position of the body, the device comprising a manipulatable structure positioned in an area of an upper portion of the body;

at least one lever pivotally mounted relative to the body about a substantially vertical axis, between a boot-retaining position and a boot release position;

a spring mounted transversely in the body and operably connected to the lever, biasing the lever toward the boot-retaining position of the lever.

* * * * *